US011278757B2

(12) United States Patent
Schmidt et al.

(10) Patent No.: US 11,278,757 B2
(45) Date of Patent: Mar. 22, 2022

(54) LOW-FRICTION SLIDER INSERT FOR SLIDING TUBES

(71) Applicant: USA Strength and Performance LLC, Greenback, TN (US)

(72) Inventors: Bryan Schmidt, Greenback, TN (US); Steve Schmidt, Greenback, TN (US); Jason Murrell, Knoxville, TN (US)

(73) Assignee: Arsenal Strength LLC, Knoxville, TN (US)

( * ) Notice: Subject to any disclaimer, the term of this patent is extended or adjusted under 35 U.S.C. 154(b) by 720 days.

(21) Appl. No.: 16/151,739

(22) Filed: Oct. 4, 2018

(65) Prior Publication Data

US 2019/0099636 A1 Apr. 4, 2019

Related U.S. Application Data

(60) Provisional application No. 62/567,870, filed on Oct. 4, 2017.

(51) Int. Cl.

| | |
|---|---|
| ***A63B 21/078*** | (2006.01) |
| ***A63B 23/04*** | (2006.01) |
| ***A63B 21/062*** | (2006.01) |
| *A63B 21/072* | (2006.01) |

(52) U.S. Cl.

CPC ..... *A63B 21/0783* (2015.10); *A63B 21/0626* (2015.10); *A63B 21/078* (2013.01); *A63B 23/0405* (2013.01); *A63B 21/0724* (2013.01); *A63B 2023/0411* (2013.01); *A63B 2225/093* (2013.01)

(58) Field of Classification Search

CPC ..... A63B 21/0626; A63B 21/0783; A63B 2225/10; A63B 23/0405; A63B 2023/0411; A63B 57/485; A63B 57/545; Y10T 403/32508; Y10T 403/7079

See application file for complete search history.

(56) References Cited

U.S. PATENT DOCUMENTS

| | | | | |
|---|---|---|---|---|
| 3,537,762 | A * | 11/1970 | Alois | F16C 29/02 384/42 |
| 5,570,957 | A * | 11/1996 | Kuly | A63B 23/00 384/42 |
| 9,950,911 | B2 * | 4/2018 | Fortunato | F16C 29/02 |
| 10,393,163 | B2 * | 8/2019 | Ucgun | A63B 21/4034 |

(Continued)

*Primary Examiner* — Joshua T Kennedy

(74) *Attorney, Agent, or Firm* — Chambliss, Bahner & Stophel, P.C.; Stephen D. Adams

(57) ABSTRACT

An apparatus having a first sliding member having an outer wall surface and an inner wall surface defining a central opening. A second sliding member having an outer wall surface and that is configured for sliding insertion into the central opening of the first sliding member. A space is formed between first and second sliding members. The first sliding member slides and may be fixed at a selected location along the length of the second sliding member. The apparatus includes a slider insert having a center section and a pair of lips that engage the first sliding member for removably mounting the slider insert to the first sliding member such that the slider insert is located in the space between the first sliding member and the second sliding member. The slider insert slides with the first sliding member and prevents the first and second sliding members from contacting on another.

18 Claims, 12 Drawing Sheets

(56) References Cited

U.S. PATENT DOCUMENTS

| | | | | |
|---|---|---|---|---|
| 2002/0043544 | A1* | 4/2002 | Caneba | A45C 13/262<br>224/584 |
| 2017/0007877 | A1* | 1/2017 | Leipheimer | A63B 21/078 |
| 2017/0361149 | A1* | 12/2017 | Duffin | A63B 21/078 |

* cited by examiner

LOW-FRICTION SLIDER INSERT FOR SLIDING TUBES

CROSS-REFERENCE TO RELATED APPLICATIONS

This application claims the benefit of U.S. Provisional Patent Application No. 62/567,870, filed on Oct. 4, 2017 and entitled LOW-FRICTION SLIDER INSERT FOR SLIDING TUBES, which is incorporated herein by reference in its entirety.

FIELD OF THE INVENTION

This invention generally relates to exercise racks. More particularly, this invention relates to a low-friction slider insert that may be removably mounted to a sliding portion of an exercise rack for reducing friction with a non-sliding portion of the exercise rack while also constraining that sliding motion to a desired pathway.

BACKGROUND OF THE INVENTION

In certain industries, collars are mounted around and slide along stationary tubes. For example, in the strength and conditioning industry, certain pieces of exercise equipment (e.g., squat racks) have barbell holders and other similar devices that are mounted to vertical columns. Barbell holders support weighted barbells and may be raised and lowered to a selected height by sliding the collar upwards and downwards along the vertical column. This exercise equipment is typically formed from steel tubing and the metal-on-metal contact often makes moving the barbell holder up and down along the vertical column difficult. One method to avoid this metal-on-metal contact is to oversize the sliding collar so that it is less likely to contact the vertical column. However, that oversizing may allow for too much "play" as the collar moves along the column. Also, the oversizing may lead to an unsafe condition where the collar is not securely connected with the column. Other methods for reducing friction include providing bearings or lubricants, which are expensive, messy, and difficult to exchange.

What is needed, therefore, is an apparatus for reducing friction between a sliding collar and a stationary tube that is safe, inexpensive, clean and can be easily removed and exchanged as needed.

SUMMARY OF THE INVENTION

The above and other needs are met by a sliding apparatus having a first sliding member having a wall with an outer wall surface and an inner wall surface opposite the outer wall surface that defines a central opening. An elongate second sliding member having a wall with an outer wall surface is sized and configured for sliding insertion into the central opening of the first sliding member. The first sliding member can slide along and be fixed at a selected location along the length of the second sliding member. A space is formed between the inner wall surface of the first sliding member and the outer wall surface of the second sliding member when the second sliding member is located within the central opening of the first sliding member. The sliding apparatus also includes a slider insert. The slider insert includes a center section and a pair of lips extending outwardly from the center section. Preferably, one lip extends along the entire width of a top end of the center section and the second lip extends along the entire width of a bottom end of the center section. The lips are configured to engage a portion of the first sliding member in order to removably mount the slider insert to the first sliding member. When the first sliding member is positioned around the second sliding member, the slider insert is located in the space between the inner wall of the first sliding member and the outer wall of the second sliding member. If correctly mounted to the first sliding member, the slider insert slides with the first sliding member along the second sliding member and prevents the first and second sliding members from contacting on another.

In certain embodiments, the slider insert flexes from an unflexed position to a flexed position in order to engage the first sliding member. The slider insert then returns to the unflexed position after being mounted to the first sliding member. Additionally, certain preferred embodiments include a locking ridge that extends away from each lip and that is located immediately adjacent the outer wall surface of the first sliding member when the slider insert is mounted to the first sliding member. The locking ridge is configured to contact the outer wall surface of the first sliding member to prevent the slider insert from being pulled away from the inner surface of the first sliding member. In certain embodiments, a rounded edge is located at an end of each of the lips proximate the locking ridge. The rounded edge contacts and slides along a portion of the first sliding member to assist in moving the slider insert to the flexed position. Certain embodiments include a flat surface that is located along an inner surface of the locking ridge. That flat surface is positioned immediately adjacent the outer wall surface of the first sliding member when the slider insert is mounted onto the first sliding member.

According to certain embodiments, a locking pin hole extends through the wall of the first sliding member. A corresponding locking pin hole also extends through the center section of the slider insert that aligns with the locking pin hole of the first sliding member when the slider insert is mounted to the first sliding member. Two or more additional locking pin holes are disposed along the length of the second sliding member. A locking pin is configured to pass through the locking pin holes of the first sliding member and the slider insert and then into the locking pin hole of the second sliding member in order to fix the first sliding member at a selected location along the length of the second sliding member.

In some embodiments, a pair of slots is formed on the first sliding member. The slots are spaced apart from one another such that a lip of the slider insert engages with one of the slots in order to removably mount the slider insert to the first sliding member. Preferably, the slots position the slider insert between left and right sides of the first sliding member and fixes the slider insert in a desired orientation and position with respect to the first sliding member. In some embodiments, the wall of the first sliding member comprises a top edge and a bottom edge. At least one of the slots is formed in the top edge or bottom edge. In some embodiments, at least one slot has a depth that is approximately equal to the thickness of the lip of the slider member disposed in the slot. As such, when the slider insert is mounted to the first sliding member, the outermost surface of the lip is in alignment with the portions of the top edge or bottom edge of the first sliding member adjacent the at least one slot. In some embodiments the wall of the first sliding member comprises a top edge and a bottom edge and one slot is formed in the top edge and the other slot is formed in the bottom edge.

According to some embodiments, the first and second sliding members have three or more sides and a separate slider insert is removably mounted to at least two sides of the first sliding member. More preferably, a separate slider insert is removably mounted to each of the three or more sides of the first sliding member.

In some cases, a first slider insert is mounted at a first location along the length of the first sliding member and a second slider insert is mounted at a second location along the length of the first sliding member. The first slider insert may be mounted at a top end of the first sliding member and the second slider insert is mounted at a bottom end of the first sliding member.

In certain cases, the apparatus includes an exercise rack having at least a pair of vertical tubes with a plurality of locking pin holes vertically disposed along at least a portion of each of the vertical tubes. A sliding collar is disposed on each of the vertical tubes. The sliding collars are each configured to slide along the vertical tube. A pin is configured to engage the pin holes for removably fixing the sliding collar at a selected vertical location. At least one sliding insert is removably mounted to each of the sliding collars and prevents the vertical tube from contacting the sliding collar as the collar slides along the vertical tube. In certain preferred embodiments, an exercise accessory is removably mounted to each of the sliding collars.

BRIEF DESCRIPTION OF THE DRAWINGS

The presently preferred embodiments of the invention are illustrated in the accompanying drawings, in which like reference numerals represent like parts throughout, and in which.

NOTES ON CONSTRUCTION

Figure 1:
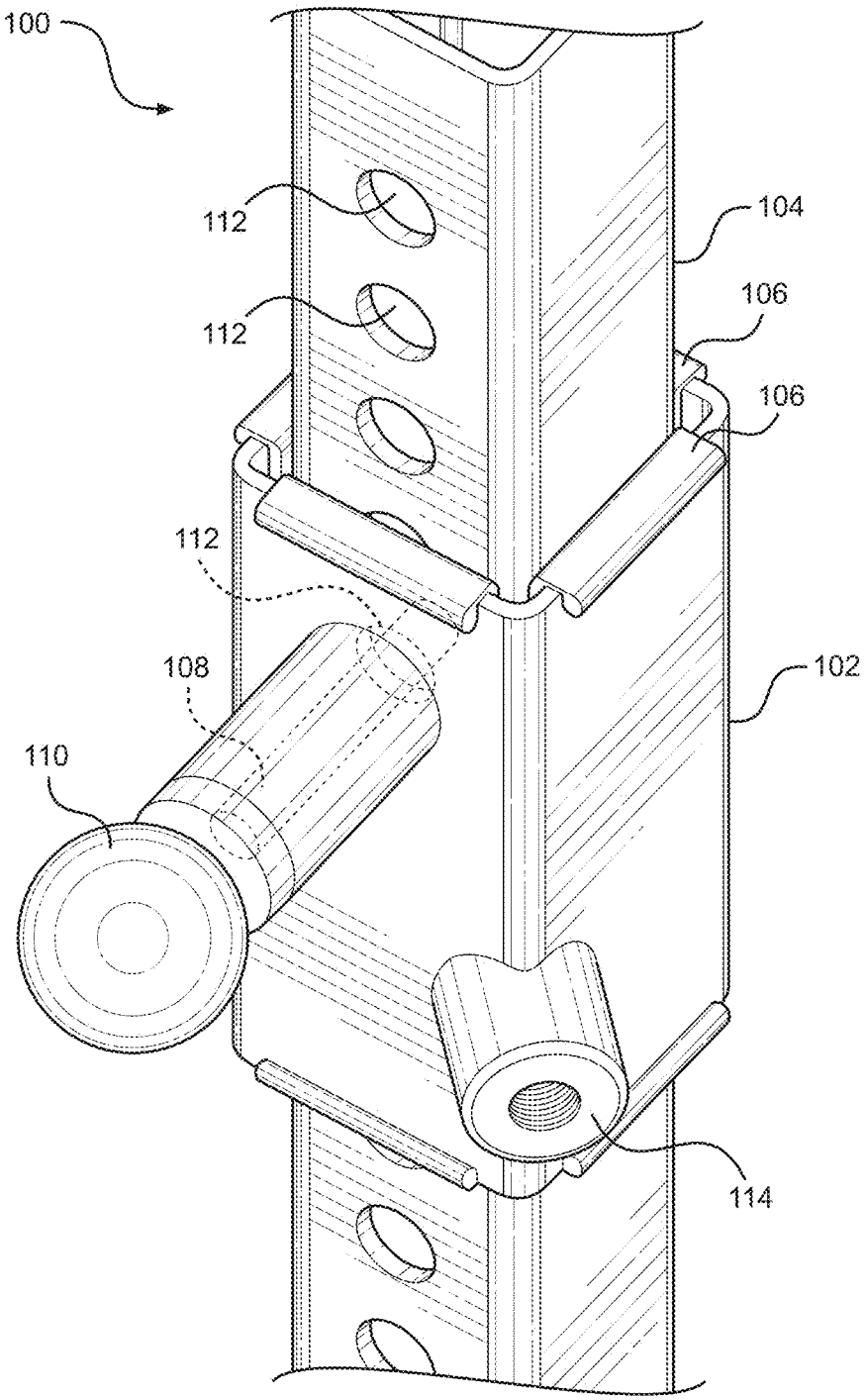
FIGS. 1-4 are top perspective views depicting a slider insert located between a first sliding member and a second sliding member according to an embodiment of the present invention.
Figure 2:
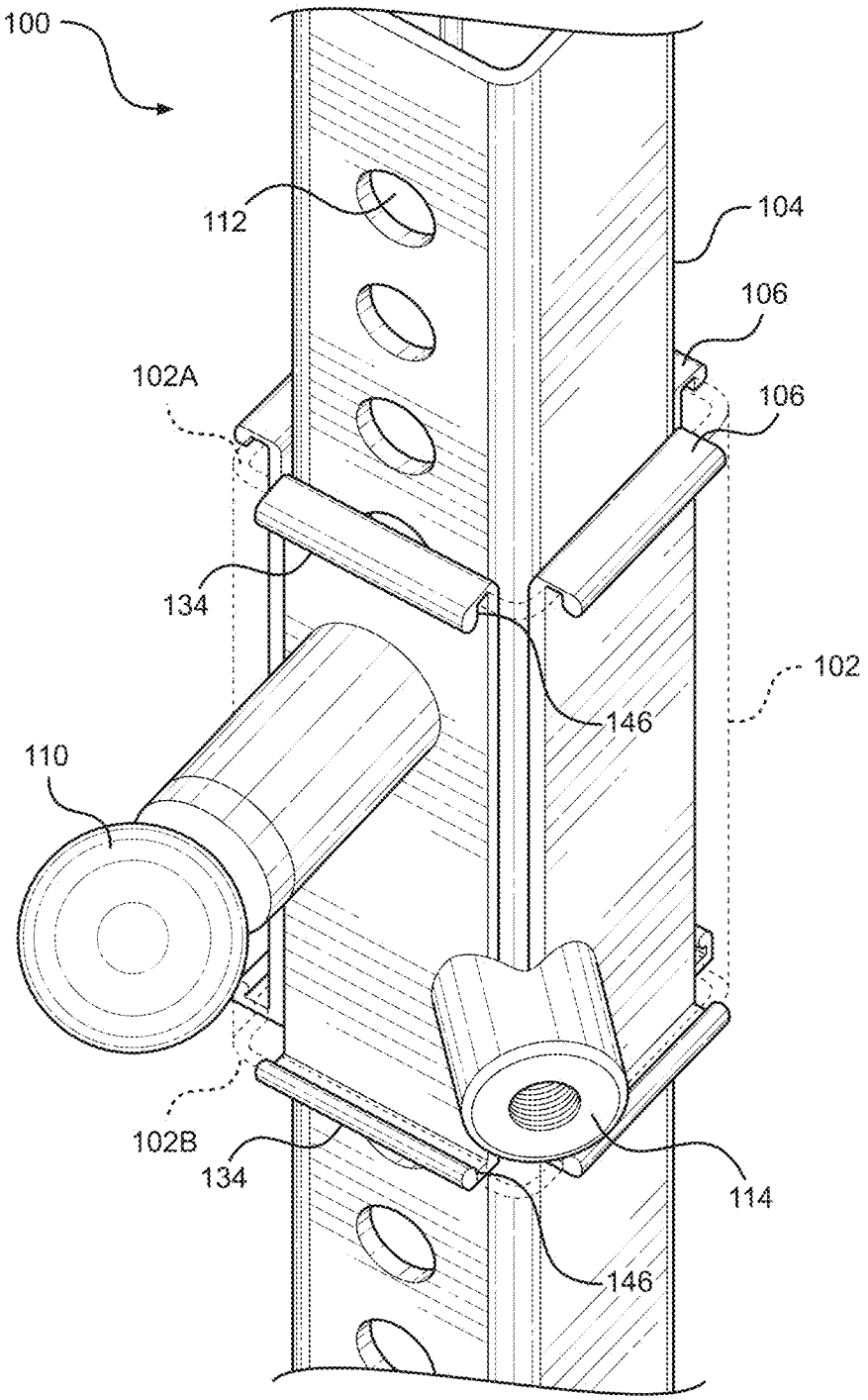
Figure 3:
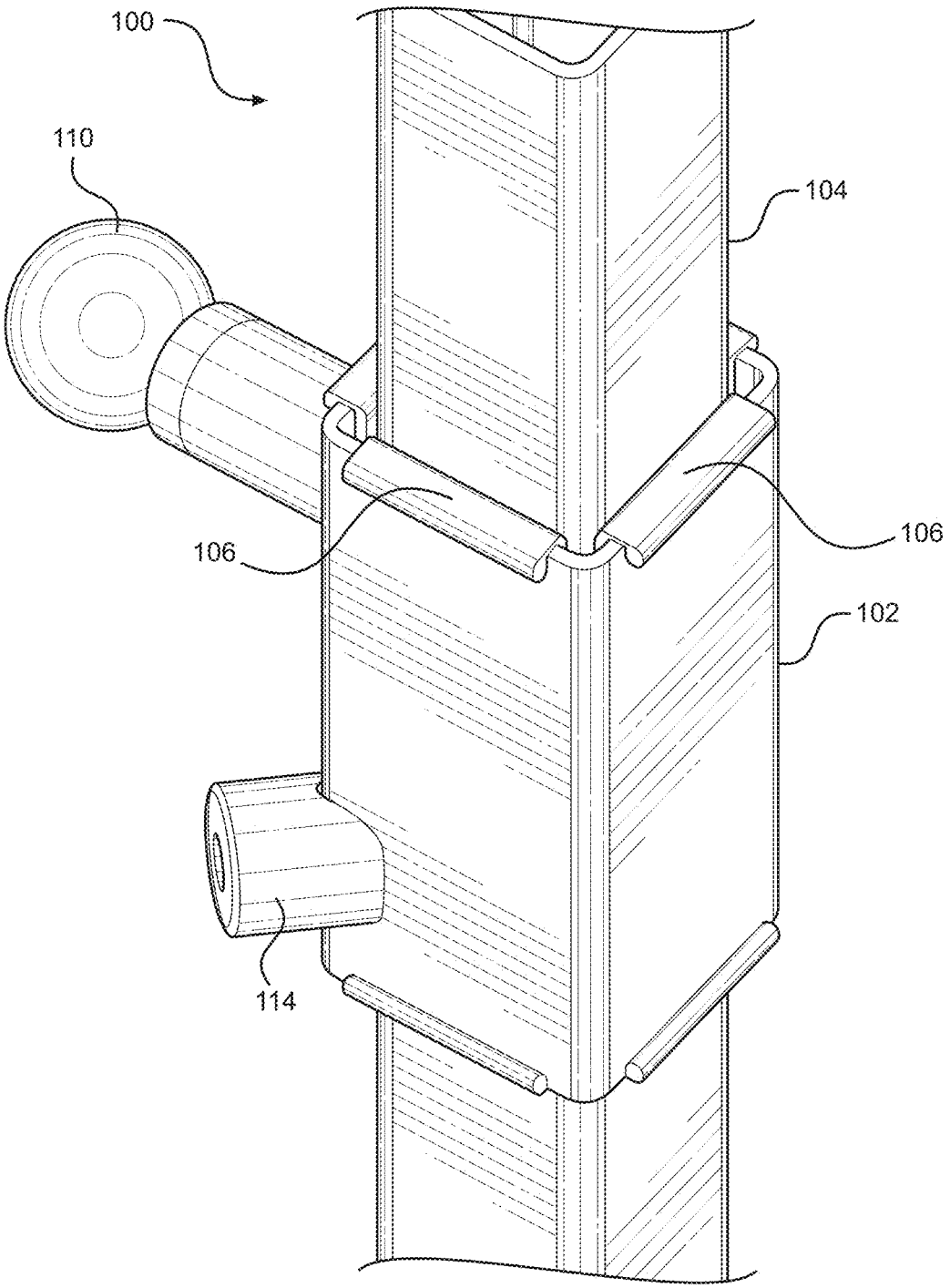

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

DESCRIPTION OF THE PREFERRED EMBODIMENTS OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Referring now to the drawings in which like reference characters designate like or corresponding characters throughout the several views, there is shown in FIGS. 1-4, a sliding apparatus 100 according to a first embodiment of the present disclosure.

The sliding apparatus 100 generally includes an outer sliding tube or first sliding member 102, an elongate stationary inner tube or second sliding member 104, and a slider insert 106 that is removably mounted to the first sliding member and is positioned between the first sliding member and the second sliding member. The first sliding member 102 slides vertically upwards and downwards along the length of the second sliding member 104, and is locked at a selected vertical position by engaging a pin 108 in a retractable plunger-type pin lock 110 with one of several locking pin holes 112 that are distributed vertically along the length of the second sliding member. The spring-loaded pin 108 is mounted to and passes through corresponding locking pin holes 112 in the first sliding member 102 and slider insert and then into the second sliding member.

Figure 5:
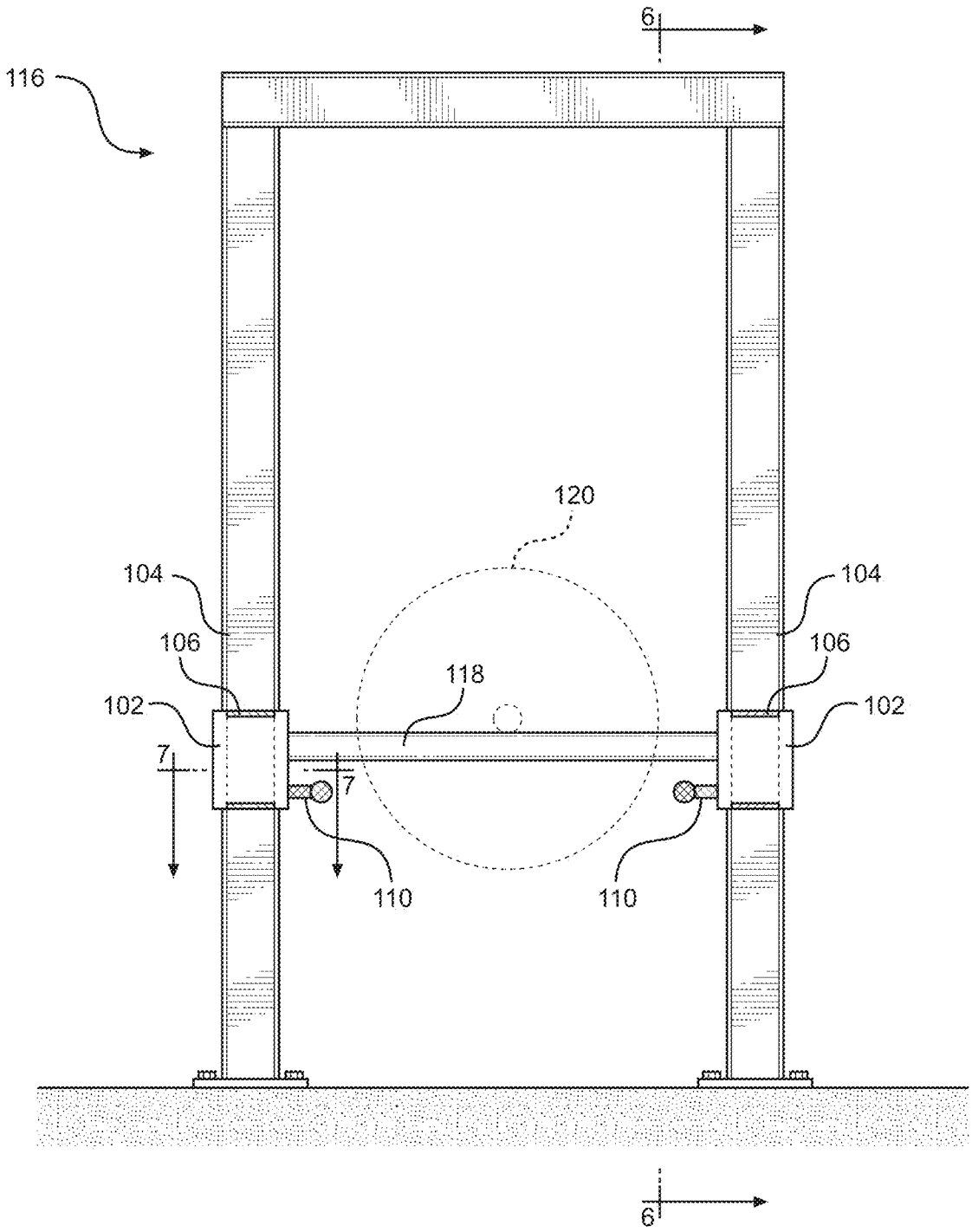
FIG. 5 is a side elevation view depicting an exercise squat rack having stationary inner tubes and sliding outer tubes including slider inserts according to an embodiment the present invention.
Figure 6:
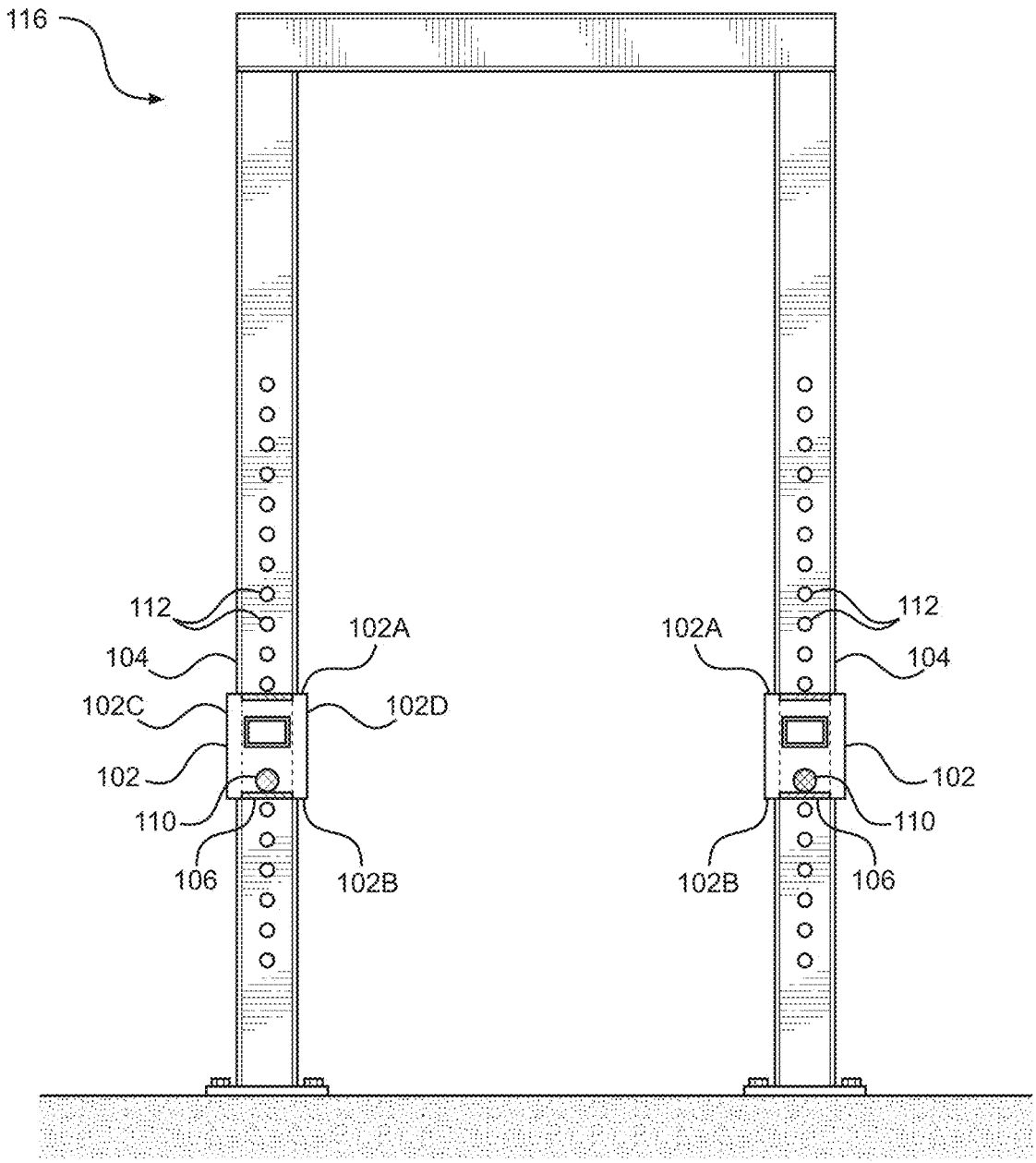
FIG. 6 is a section view of the exercise squat rack of FIG. 5 taken along cut line 6-6.
Figure 7:
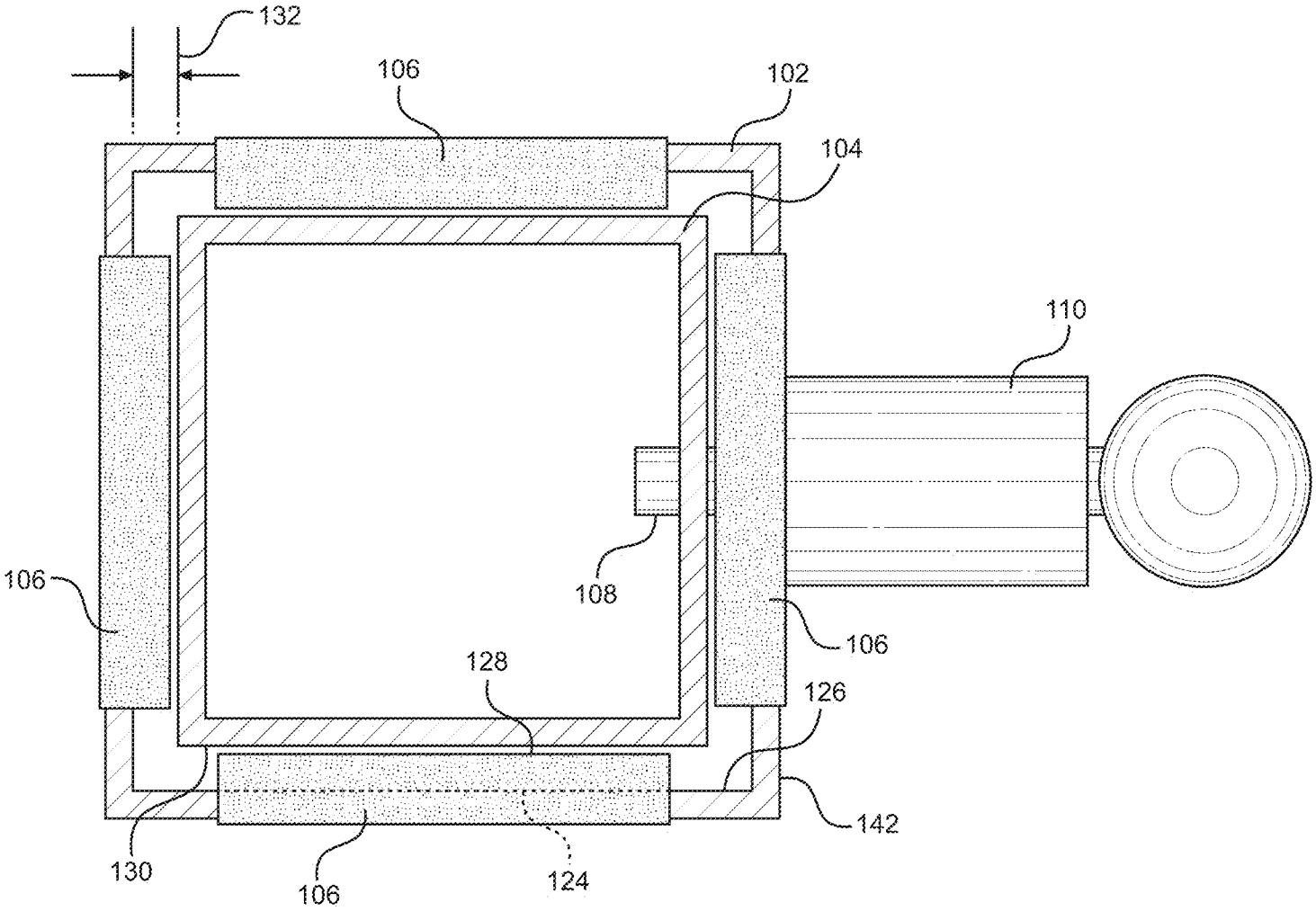
FIG. 7 is a section view of the exercise squat rack of FIG. 5 taken along cut line 7-7.

Accessories may be mounted to the first sliding member 102 and moved vertically upwards and downwards. For example, an accessory may be attached to the first sliding member 102 using the threaded connection point 114 located on one corner of the first sliding member. Other accessories may be mounted to the first sliding member through welding or other well-known connection means. For example, as shown in FIGS. 5-7, an exercise squat rack 116 is provided with multiple outer sliding tubes 102 (also called "collars") surrounding stationary inner tubes 104. On each side of the left and right sides of the squat rack 116, exercise accessories 118 (such as barbell supports or bar catches) are mounted between outer sliding tubes 102 located at the front and back of the squat rack. The barbell support are used, for example, to hold a barbell 120 at a selected vertical position. The outer sliding tubes (collars) 102 and the barbell support 118 may be moved vertically upwards or downwards as a single unit. In other embodiments, the barbell support 118 may be removed from the outer sliding tubes 102 prior to raising or lowering the sliding tubes. The outer sliding tubes 102 are then moved to the desired location and then the barbell support 120 is re-mounted onto the outer sliding tubes at the new vertical position. The outer sliding tubes 102 are fixed at a selected location using retractable pin locks 110. Slider inserts 106 are placed onto each of the outer sliding tubes 102. In preferred embodiments, a separate slider insert 106 is placed on each of the four sides of the outer sliding tube 102.

Figure 8:
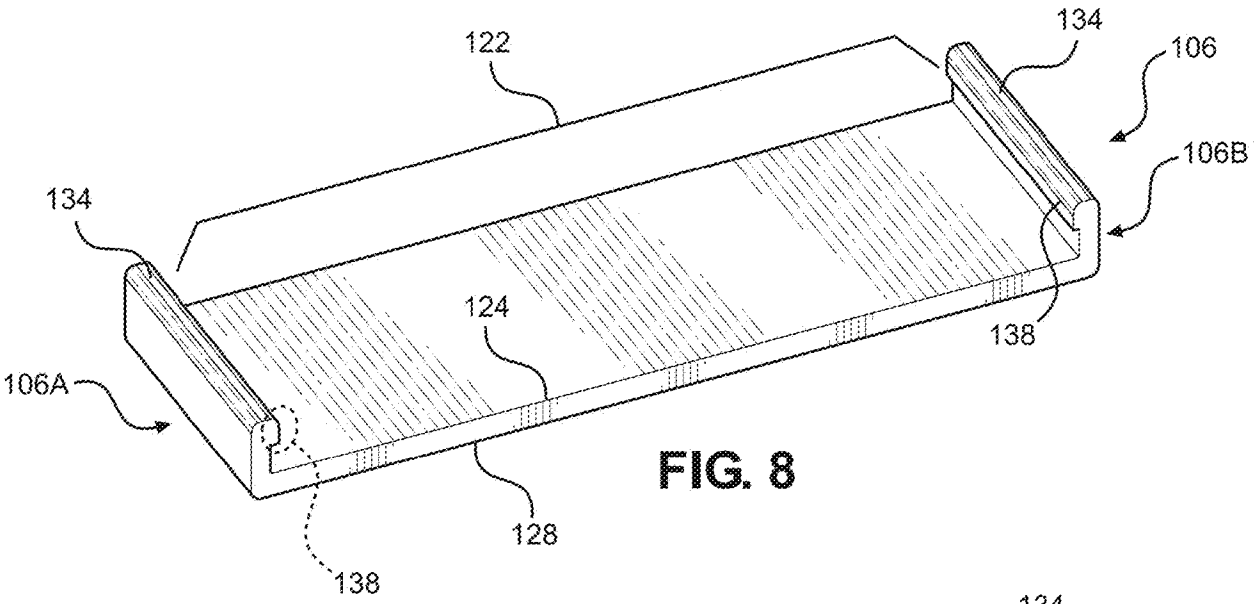
FIGS. 8 and 9 are top perspective views depicting a slider insert according to an embodiment of the present invention.
Figure 9:
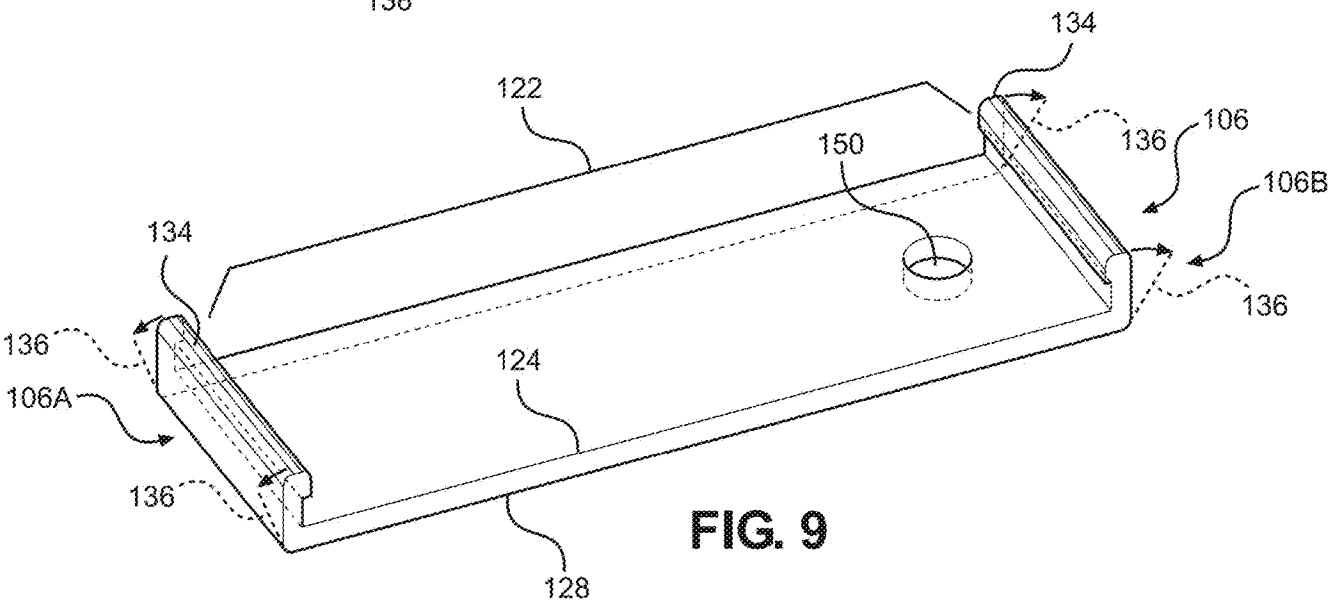
Figure 10:
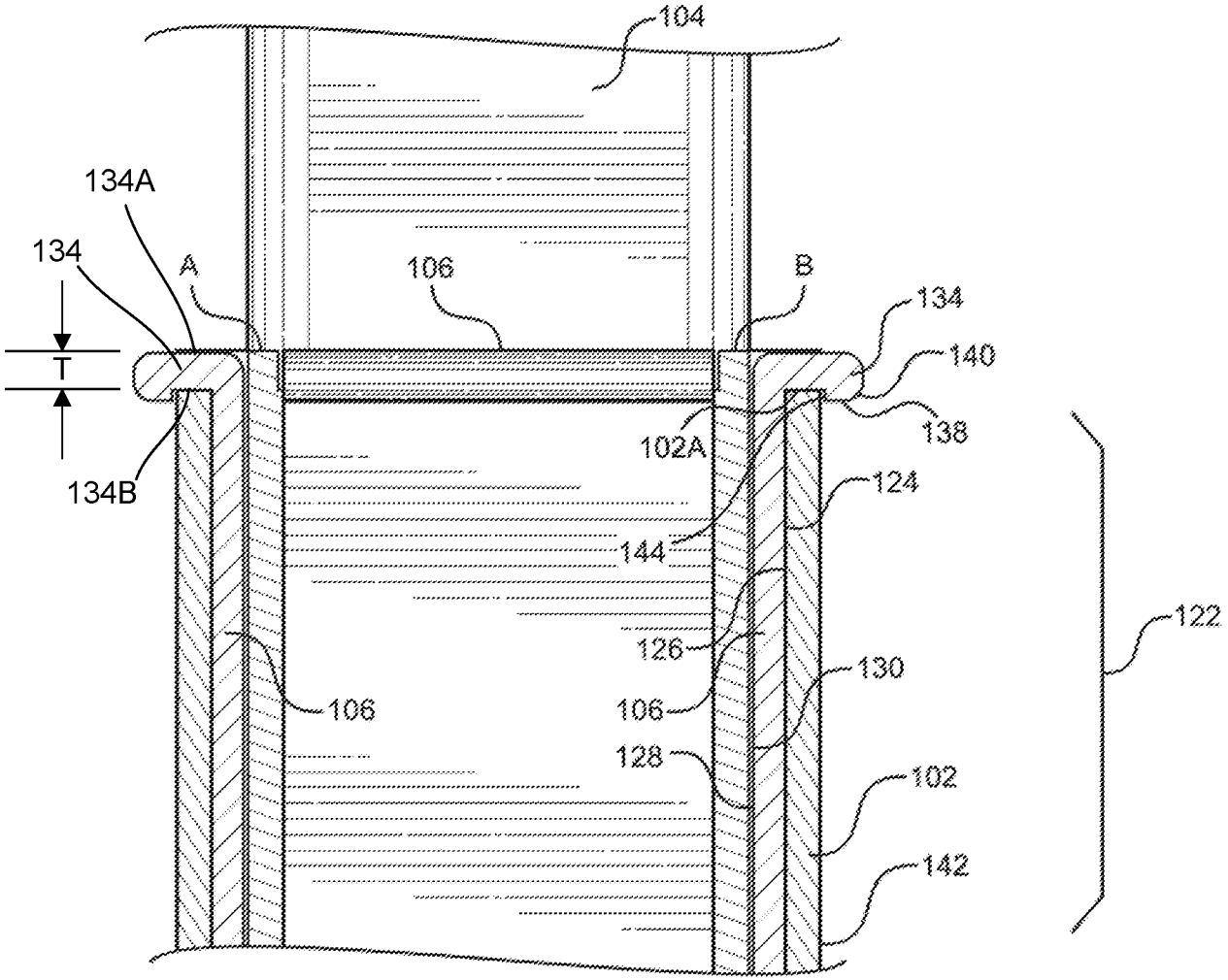
FIG. 10 depicts a portion of a slider insert located between a first sliding member and a second sliding member.

The slider insert 106 is best shown in FIGS. 8-10. Each slider insert 106 is generally C-shaped and has a flat center section 122 that, when correctly installed, is located between the first and second sliding members 102, 104. The inside surface 124 of the center section 122 is placed against an inside surface 126 of the first sliding member 102 and an outer surface 128 of the center section 122 slides over an outer surface 130 of the second sliding member 104. A primary purpose of the slider insert 106 is to eliminate sliding friction caused by metal on metal contact when two telescoping or sliding members slide past one another. Accordingly, the center section 122 is ideally formed using a material, such as acetal plastic, having a low friction coefficient. For example, a suitably low friction coefficient is in the range of about 0.1 to about 0.6. More preferable is a material having a friction coefficient in the range of about 0.2 to about 0.4. However, higher or lower friction coefficients may also be suitable.

Additionally, the slider 106 insert helps to guide the first sliding member 102 smoothly along the second sliding member 104 by eliminating wobble resulting from too much spacing in the gap area 132 located between the first and second sliding members (FIG. 7). Accordingly, the slider inserts 106 are sized so that their width significantly reduces the amount of spacing around the outside surface of the second sliding member 104. By sizing the slider inserts 106 so that they extends inwards very near the outside surface 130 of the second sliding member 104, the slider inserts function as a guide to assist the first sliding member 102 to slide smoothly along the second sliding member. This could be accomplished by placing a single insert around the entire inner surface 126 of the first sliding member 102. However, more preferably, a separate slider insert 106 is removably mounted to each side of the first sliding member 102. Using separate slider inserts 106 on each side of the first sliding member 102 greatly simplifies the manufacturing, installation, and removal processes.

Depending on the mounting location of each sliding insert 106, one or more holes 150 may be required in the center section 122 in order to accommodate locking pins 108, as shown previously. For example, the slider inserts 106 illustrated in FIG. 6 would require at least one hole in the center section in order to accommodate a locking pin. On the other hand, as shown in FIG. 5, for sides where no locking pin is located, the central section may be solid and without holes.

Figure 12:
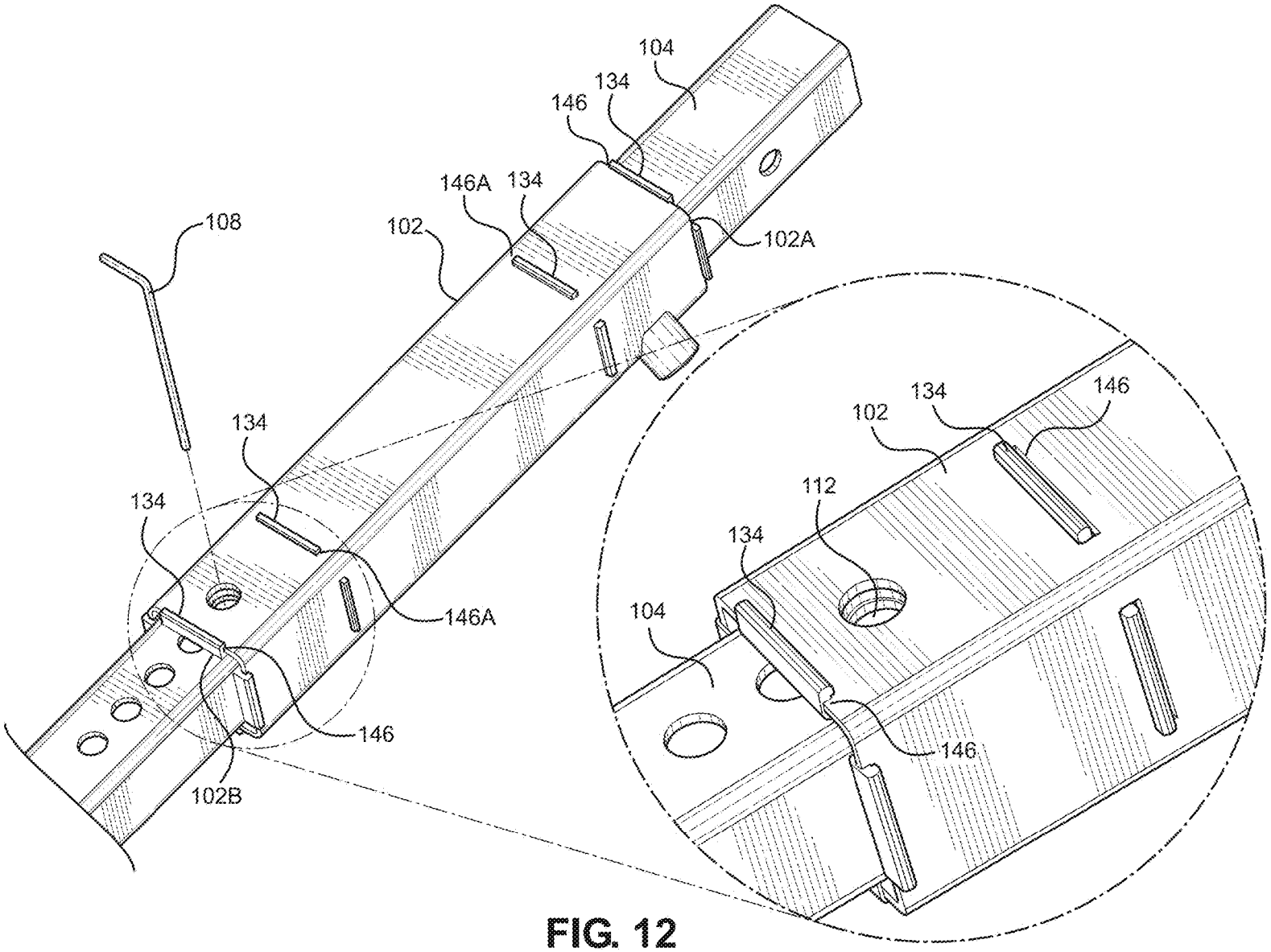
FIGS. 12 and 13 depict separate groups of slider inserts disposed spaced apart along the length of second sliding member and at opposite ends of a first sliding member according to an alternative embodiment of the present invention.

Referring to FIGS. 8-10, lips 134 extending outwards from the slider insert 106 are used to mount the slider insert to the first sliding member 102. Preferably, these lips 134 are integrally formed with the center section 122 such that the entire slider insert 106 is formed as a single unitary component. The lips 134 extend away from the top and bottom ends (106A, 106B) of the slider insert 106. As illustrated in FIG. 10 and FIG. 12, the slider insert is mounted to the inside surface 126 of the first sliding member 102 by placing a portion of the lips over the top and bottom edges (102A, 102B) of the first sliding member. Preferably, the lips 134 span the entire width of the top and bottom ends 106A, 106B of the slider insert 106. This increases the strength of the lips 134 and maximizes the surface area for gripping the first sliding member 102.

Referring to FIG. 9, the lips 134 preferably extend directly outwards from inside surface 124 of the center section 122. This is the default unflexed position of the slider insert 106. However, the slider insert 106 and lips 134 are designed, when acted upon by a force, to flex outwards to a flexed position 136. Preferably, the slider insert 106 is sized so that it must be in the flexed position 136 in order for at least a portion of the slider insert to be placed over the edges 102A, 102B of the first sliding member 102. This sizing helps to ensure that the slider insert 106 will not be too easily or unintentionally removed from the first sliding member 102. Additionally, locking ridges 138 are placed along the entire width of the lips 134 and extend away from the inner surface of the lips towards the center section 122.

As may be appreciated by viewing FIG. 10, during the installation process, the slider insert 106 must be flexed outwards to the flexed position so that the locking ridge 138 can move over and past the edge 102A (and edge 102B, which is not shown) of the first sliding member 102. Preferably, this may be carried out by simply pressing the slider insert 106 against the first sliding member until the lips 134 are flexed outwards to the flexed position 136. To facilitate this flexing process, a rounded leading edge 140 is provided between the leading end of the lip 134 and the locking ridge 138. This rounded edge 140 contacts the edge 102A of the first sliding member 102 as it is being installed and assists in flexing the lip 134 outward. A similar structure is provided at the opposite end of the slider insert 106 that contacts the bottom edge 102B of the first sliding member 102. As the lip 134 passes over the top edge 102A of the first sliding member 102, the locking ridge 138 snaps over the edge and it is located adjacent an outer surface 142 of the first sliding member.

To assist in preventing the locking ridge 138 from accidentally becoming disengaged from the first sliding member 102, the inner surface 144 of the locking ridge (opposite the rounded edge 140 discussed previously) is flat. When the insert 106 is correctly installed, this flat inner surface 144 is preferably positioned immediately adjacent the outer surface 142 of the first sliding member 102 and helps to prevent the slider insert 106 from flexing or slipping off of the first sliding member. In combination, these features provide a fast and easy installation process that also ensures a very secure connection between the slider insert 106 and the first sliding member 102.

Figure 11:
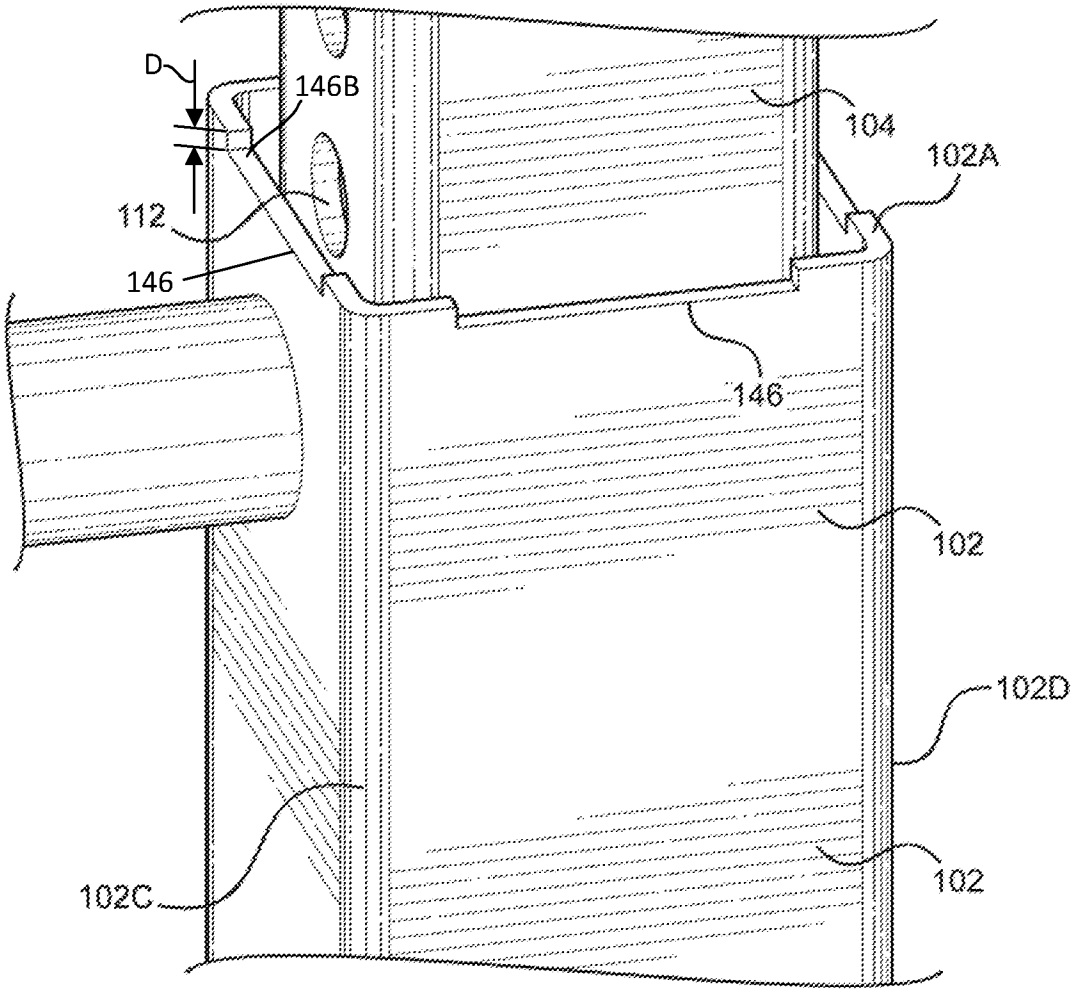
FIG. 11 depicts a slot formed on a top edge of a first sliding member according to an embodiment of the present invention.

With reference to FIGS. 10-12, in addition to mounting the slider insert 106 to the first sliding member 102, the lips 134 also assist in correctly positioning between the left and right edges (102C, 102D) of the first sliding member 102 and to maintain that correct positioning and a desired orientation with respect to the first sliding member 102. The lips 134 are designed to be seated in a pair of slots 146 that are located at the desired positioning between the left and right edges 102C, 102D of the first sliding member 102. These slots 146 may be located at any position along the vertical extent of the first sliding member 102 (i.e., at any positioned between the top and bottom ends). In this particular embodiment, one of the slots 146 is formed in the top edge 102A of a first sliding member 102. The lip 134 of the slider insert 106 is sized to fit within the slot 146 and the slot prevents the slider insert from moving too far in either the left or right direction and from moving upwards or downwards along the length of the first sliding member. Accordingly, the slot 134 functions as a centering mechanism for the slider insert 106. It may also be appreciated that the slots 146 keep the slider inserts 106 at the desired orientation, which in this case is vertical. Finally, the slots 146 are ideally deep enough so that an outer surface 134A of the slider insert lip 134 (the topmost surface of the lip in this case) aligns with the portions of the first sliding member adjacent the slot (denoted here using the letters "A" and "B"). The outer surface 134A of each lip 134 is located opposite an inner surface 134B and each lip has a thickness T that is measured from the inner surface to the outer surface. Next, each slot 146 has a depth D that is measured from a bottom surface 146B of the slot to either the top edge 102A or the bottom edge 102B of the first sliding member 102, depending on which end of the first sliding member the slot is formed on. As shown best in FIG. 10, the thickness T of each lip 134 is equal to the depth D of the slot 146 such that the outer surface 134A aligns with the portions of the top edge 102A or bottom edge 102B located adjacent the slot. This ensures that the slider insert 106 does not extend vertically beyond either the top or bottom edge 102A, 102B of the first sliding member 102.

Figure 4:
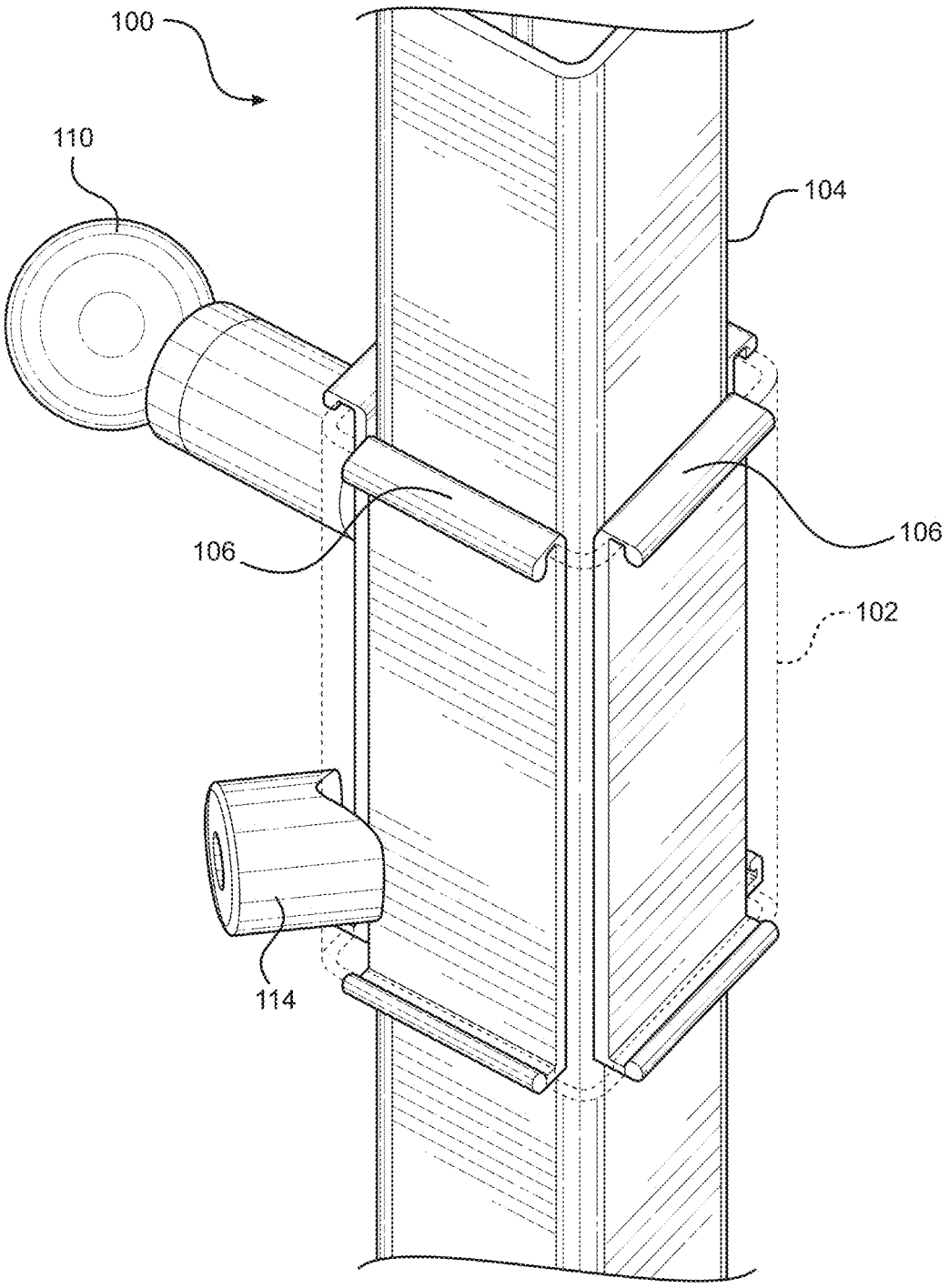
Figure 13:
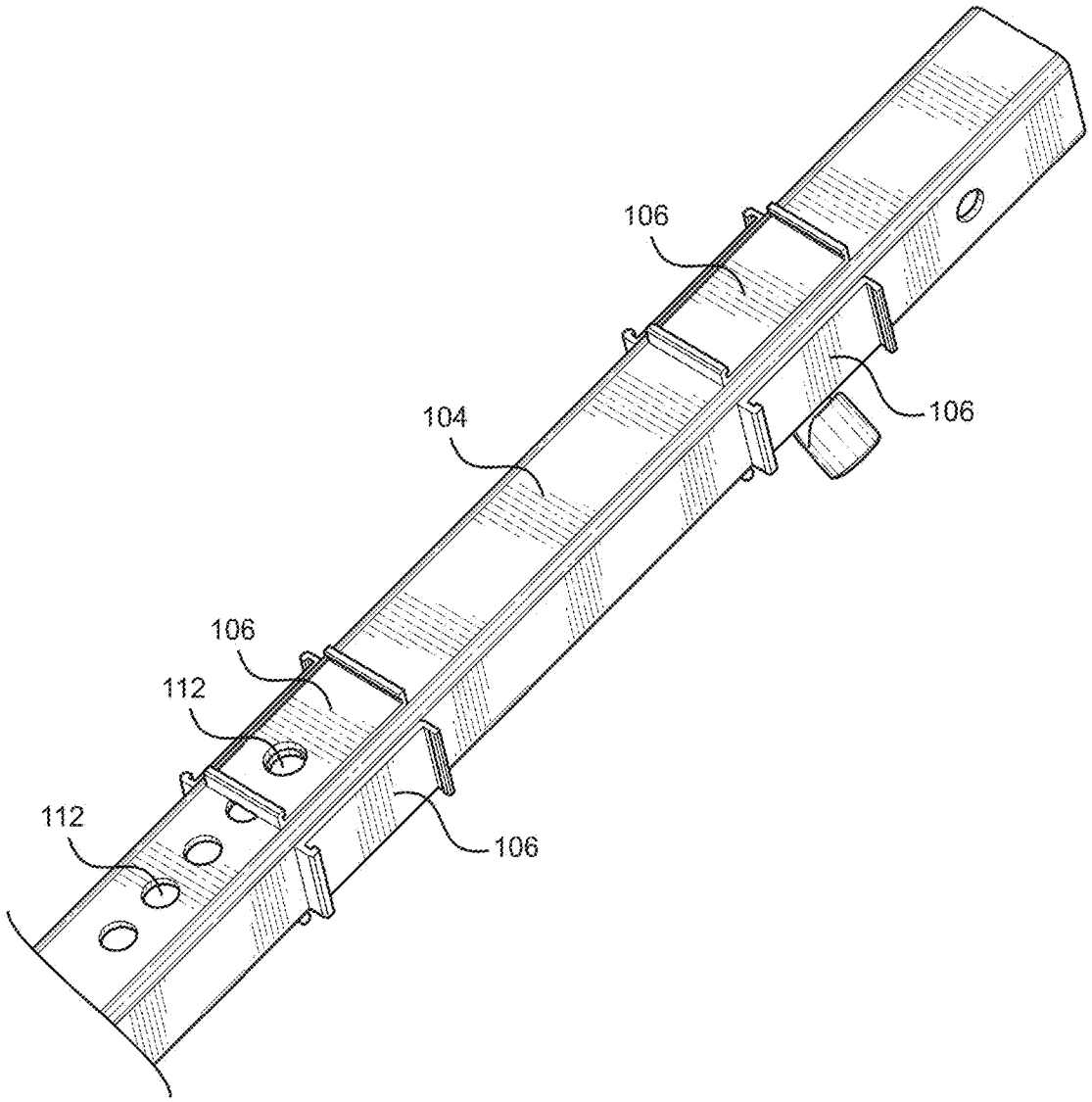

Referring to FIG. 4, slots for receiving lips of the slider insert 106 may be provided at both the top and bottom edges 102A, 102B of the first sliding member 102. However, in other embodiments, slots 146 may be provided at an intermediate location between the top and bottom edges 102A, 102B of the first sliding member 102. This may be useful, for example, when the first sliding member 102 is longer than the slider insert 106. An example of such a case is provided in FIGS. 12 and 13. In this case, the first sliding member 102 is much longer than the slider insert 106 that is mounted to it. Accordingly, two groups of slider inserts 106 are mounted to the first sliding member 102, including a first group of slider inserts near the bottom edge 102B of the first sliding member and a second group of slider inserts near the top edge 102A of the first sliding member. For each group, one lip 134 of each of the slider inserts is mounted to a slot 146 located along the top or bottom edge 102A, 102B of the first sliding member 102. The other lip 134 of each slider insert 106 is mounted to an intermediate slot 146A that is located between the top and bottom edges 102A, 102B. Still, in other embodiments, both lips 134 may be mounted at an intermediate location between the top and bottom edges 102A, 102B of the first sliding member 102.

In the description above, the second sliding member 104 is shown and described as a "tube," which suggests a hollow interior. However, a bar having a solid interior could be used as a second sliding member 104 as an alternative. Additionally, in the description above, the first sliding member 102 (i.e., the outer tube) slides along the second sliding member 104 (i.e., the inner tube) and the second sliding member remains stationary. However, in other embodiments, the first sliding member 102 maybe held stationary while the second sliding member 104 slides. In still other embodiments, both sliding members 102, 104 may slide simultaneously with one another.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates.

What is claimed is:

1. A sliding apparatus comprising:

a first sliding member having a wall formed by a plurality of sides, the wall having an outer wall surface and an inner wall surface opposite the outer wall surface that defines a central opening;

an elongate second sliding member having a wall with an outer wall surface, the second sliding member sized and configured for sliding insertion into the central opening of the first sliding member such that the first sliding member slides along the second sliding member along a first axis that is parallel with the outer wall of the second sliding member;

a space formed between the inner wall surface of the first sliding member and the outer wall surface of the second sliding member when the second sliding member is located within the central opening of the first sliding member;

a pair of spaced apart slots formed in one of the sides of the wall of the first sliding member, wherein one of the pair of slots is located at a first position along the first axis and the other one of the pair of slots is located at a second and different position along the first axis;

a low-friction slider insert comprising:

a flat center section having an inside surface that, when the slider insert is mounted to the first sliding member, faces the inner wall surface of said one side of the plurality of sides of the first sliding member;

a pair of lips extending outwardly away from the inside surface of the flat center section, wherein one lip of the pair of lips positively engages each one of the pair of slots of the first sliding member in order to mount the slider insert to the first sliding member such that the slider insert is positioned in the space between the inner wall of the first sliding member and the outer wall of the second sliding member and slides with the first sliding member along the second sliding member.

2. The apparatus of claim 1 wherein the slider insert is configured to flex from an unflexed positioned to a flexed position during the installation process in order to be mounted to the first sliding member and to return to the unflexed position when mounted to the first sliding member.

3. The apparatus of claim 2 further comprising a locking ridge extending away from each lip that is located immediately adjacent the outer wall surface of the first sliding member when the slider insert is mounted to the first sliding member such that a portion of the first sliding member is positioned between each locking ridge and the center section of the slider insert and the locking ridge contacts the outer wall surface of the first sliding member to prevent the slider insert from being pulled away from the inner surface of the first sliding member.

4. The apparatus of claim 3 further comprising a rounded edge located at an end of each of the lips proximate the locking ridge, which rounded edge contacts and slides along a portion of the first sliding member to assist in moving the slider insert to the flexed position.

5. The apparatus of claim 3 further comprising a flat surface located along an inner surface of the locking ridge, which flat surface is positioned immediately adjacent the outer wall surface of the first sliding member when the slider insert is mounted onto the first sliding member.

6. The apparatus of claim 1 wherein a first lip of the pair of lips extends along an entire width of a top end of the center section and a second lip of the pair of lips extends along an entire width of a bottom end of the center section.

7. The apparatus of claim 1 further comprising:

a locking pin hole extending through the wall of the first sliding member;

a locking pin hole extending through the center section of the slider insert that aligns with the locking pin hole of the first sliding member when the slider insert is mounted to the first sliding member;

two or more locking pin holes disposed along the length of the second sliding member; and a locking pin configured to pass through the locking pin holes of the first sliding member and the slider insert and into the locking pin hole of the second sliding member in order to fix the first sliding member at a selected location along the length of the second sliding member.

8. The apparatus of claim 1 wherein each of the first and second sliding members have three or more sides and a separate slider insert is removably mounted to at least two sides of the first sliding member.

9. The apparatus of claim 8 wherein a separate slider insert is removably mounted to each of the three or more sides of the first sliding member.

10. The apparatus of claim 1 wherein a first slider insert is mounted at a first location along the length of the first sliding member and a second slider insert is mounted at a second location along the length of the first sliding member.

11. The apparatus of claim 1 wherein:

at least one of the pair of slots is formed in and extends from a top edge or a bottom edge of the wall of the first sliding member and each of the slots is provided with a bottom surface;

each lip is provided with an inner surface that faces the bottom surface of the slot when the slider insert is mounted to the first sliding member and an outer surface of the lip that is located opposite the inner surface;

each lip has a thickness measured from the inner surface to the outer surface;

the at least one slot has a depth that is measured from the bottom surface of the at least one slot to the top edge or bottom edge in which the at least one slot is formed; and the depth of the at least one slot is equal to the thickness of the lip disposed in the slot such that, when the slider insert is mounted to the first sliding member, the outer surface of the at least one lip aligns with portions of the top edge or bottom edge of the first sliding member adjacent the at least one slot.

12. The apparatus of claim 11 wherein the positive engagement of the lips with the pair of slots positions the slider insert between left and right sides of the first sliding member and fixes the slider insert in a desired orientation and position with respect to the first sliding member.

13. The apparatus of claim 11 wherein the other one of the pair of slots is disposed between the top edge and bottom edge.

14. The apparatus of claim 11 wherein one of the pair of slots is formed in and extends from the top edge of the wall of the first sliding member and the other one of the pair of slots is formed in and extends from the bottom edge of the wall of the first sliding member, and the depth of each slot is equal to the thickness of the lip disposed in the slot such that, when the slider insert is mounted to the first sliding member, the outer surface of each lip aligns with portions of the corresponding top edge or bottom edges of the first sliding member.

15. A low-friction slider insert configured for use in connection with fitness equipment that includes a first sliding member having a plurality of interconnected planar sides formed by a wall that includes an outer wall surface and an inner wall surface opposite the outer wall surface that defines a central opening; an elongate second sliding member having a wall with an outer wall surface and sized and configured for sliding insertion into the central opening of the first sliding member, wherein the first sliding member is configured to slide along the second sliding member such that the outer wall surface of the second sliding member is located immediately adjacent to and can contact the inner wall surface of the first sliding member; and a space formed between the inner wall surface of the first sliding member and the outer wall surface of the second sliding member when the second sliding member is located within the central opening of the first sliding member, the low-friction slider insert comprising:

a low-friction planar center section having a top end, a bottom end, an inside surface, and an outer surface that is located opposite the inside surface, wherein the planar center section is sized and configured for placement adjacent a single one of the plurality of interconnected planar walls of the first sliding member at a time when the low-friction slider insert is connected to the first sliding member; and a lip formed at the top and bottom ends of the center section and extending outwards from the inside surface, each lip configured to removably connect to the first sliding member such that the planar center section is positioned adjacent only the one side of the first sliding member and located in the space between the inner wall of the one side of the first sliding member and the outer wall of the second sliding member and slides with and guides the first sliding member along the second sliding member while preventing the inner wall surface of the one side of the first sliding member from contacting the outer wall surface of the second sliding member.

16. The slider insert of claim 15 further comprising a locking ridge extending away from each lip that is located immediately adjacent the outer wall surface of the first sliding member when the slider insert is mounted to the first sliding member such that a portion of the first sliding member is positioned between each locking ridge and the center section of the slider insert and the locking ridge contacts the outer wall surface of the first sliding member to prevent the slider insert from being pulled away from the inner surface of the first sliding member.

17. A method comprising the steps of:

providing a sliding apparatus comprising: a first sliding member having at least three interconnected planar sides formed by a wall that includes an outer wall surface and an inner wall surface opposite the outer wall surface that defines a central opening; an elongate second sliding member having a wall with an outer wall surface, wherein the second sliding member is slidably located within the central opening of the first sliding member such that the outer wall surface of the second sliding member is located immediately adjacent to and can contact the inner wall surface of the first sliding member;

providing a low-friction slider insert comprising: a planar center section having an inside surface; and a pair of lips extending outwardly away from the inside surface of the planar center section;

removably connecting the low-friction slider insert to the first sliding member by positively engaging the pair of lips of the low-friction slider insert with one of the sides of the first sliding member such that the planar center section is positioned adjacent only the one side of the first sliding member and is located between the inner wall of the one side of the first sliding member and the outer wall of the second sliding member and slides with and guides the first sliding member along the second sliding member while preventing the inner wall surface of the one side of the first sliding member from contacting the outer wall surface of the second sliding member.

18. The method of claim 17 further comprising the steps of:

providing a plurality of low-friction slider inserts; and removably connecting the low-friction slider inserts to the first sliding member by positively engaging the pair of lips of each of the plurality of low-friction slider inserts with a different one of the plurality of sides of the first sliding member such that the planar center section of each low-friction slider insert is positioned adjacent only one side of the first sliding member and the planar center section of each of the low-friction inserts is located between the inner wall of the corresponding one side of the first sliding member and the outer wall of the second sliding member, wherein each of the low-friction slider inserts slides with and guides the first sliding member along the second sliding member while preventing the inner wall surface of only one side of the first sliding member from contacting the outer wall surface of the second sliding member.

* * * * *